United States Patent [19]

Yamagami et al.

[11] 4,156,164

[45] May 22, 1979

[54] DISPLAY DEVICE USING HOT CATHODE GAS DISCHARGE

[75] Inventors: Teiichi Yamagami, Kawachinagano; Mitsuharu Tsuchiya, Katano; Tetsuro Ohtsuka, Takatsuki, all of Japan

[73] Assignee: Matsushita Electric Industrial Co., Ltd., Osaka, Japan

[21] Appl. No.: 888,976

[22] Filed: Mar. 21, 1978

[30] Foreign Application Priority Data

Mar. 28, 1977 [JP] Japan ..... 52-34860
Mar. 31, 1977 [JP] Japan ..... 52-37256

[51] Int. Cl.[2] ..... H05B 37/00; H05B 39/00; H05B 41/00

[52] U.S. Cl. ..... 315/169.4; 340/771

[58] Field of Search ..... 315/169 R, 169 TV; 340/324 M

[56] References Cited

U.S. PATENT DOCUMENTS 3,749,969 7/1973 Miyashiro et al. ..... 315/169 TV
4,066,929 1/1978 Okamoto et al. ..... 315/169 TV

OTHER PUBLICATIONS

"Gas Discharge Displays: The State of the Art", Sobel, IEEE Transactions on Electron Devices, vol. ED24, No. 7, Jul. 1977.

*Primary Examiner*—Alfred E. Smith
*Assistant Examiner*—Robert E. Wise
*Attorney, Agent, or Firm*—Wenderoth, Lind & Ponack

[57] ABSTRACT

A d.c. gas-discharge display device has gas-discharge display panel including hot cathodes inserted in a thermal electron generating space, an insulating plate having holes as discharge-glow spaces and on one surface thereof grid electrodes with holes for penetration of thermal electrons and on another surface thereof anode electrodes, and gas, metallic vapor on a mixture thereof, which fills the space in the display panel and forms an envelope. A voltage generator supplies the cathodes with a potential to provide thermal electrons. A first pulse generator supplies the grid electrodes with a pulse having a pulse height higher than $V_{ON}$ and being biased by a d.c. voltage lower than $V_{OFF}$.

A second pulse generator supplies the anode electrodes with a positive pulse having a pulse height higher than the ionization voltage of the gas, metallic vapor or mixture and being biased by a d.c. voltage between ground level and the ionization voltage. The discharge glow in each discharge hole is thus turned on during the time the pulse applied to the grid electrode coincides with the pulse applied to the anode electrode.

6 Claims, 23 Drawing Figures

TABLE I

| | | |
|---|---|---|
| GAS FILLING | | Ne+0.7% A 8mmHg |
| GRID SCANNING | DUTY FACTOR D | 1/13 |
| | SELECTION VOLTAGE $v_1$ | +8V |
| | REMAINING VOLTAGE BIAS $v_2$ | −5V |
| ANODE SIGNAL | APPLIED VOLTAGE $v_A$ | +38V |
| | CURRENT DENSITY $i_A$ | 0.1mA/mm$^2$ |
| | SERIES RESISTOR $R_A$ | 120KΩ |
| POWER SPENDING | | 0.4w/cm2 |
| LUMINANCE | | 50fL |
| CONTRAST RATIO | | >30:1 |

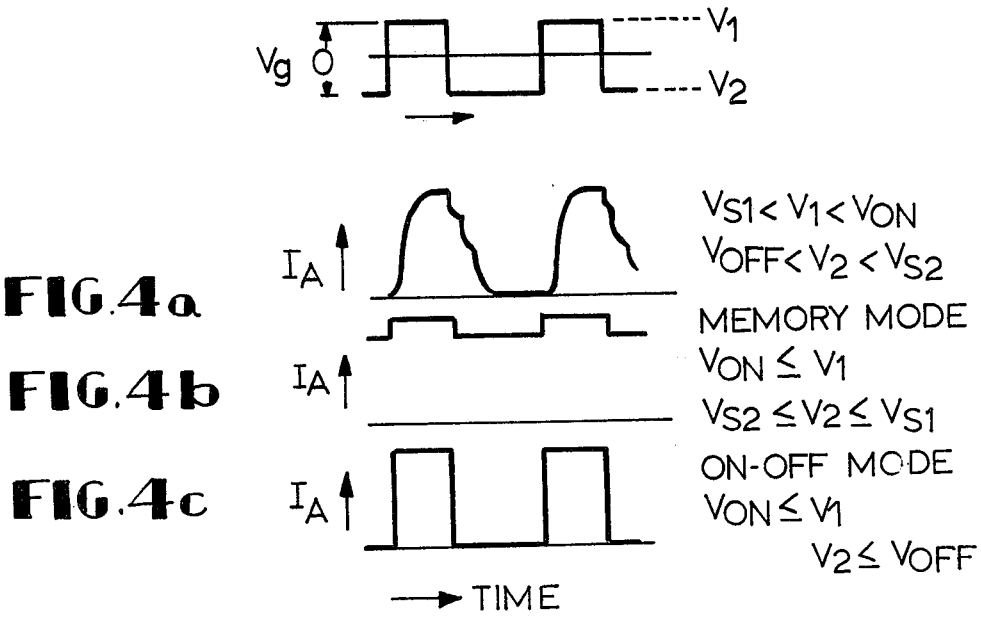
FIG.4a
FIG.4b
FIG.4c
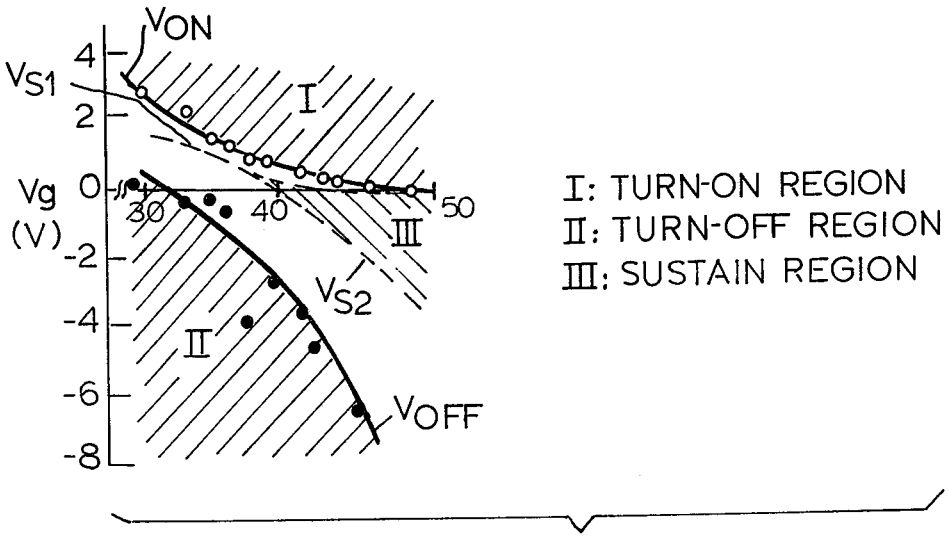
FIG.5

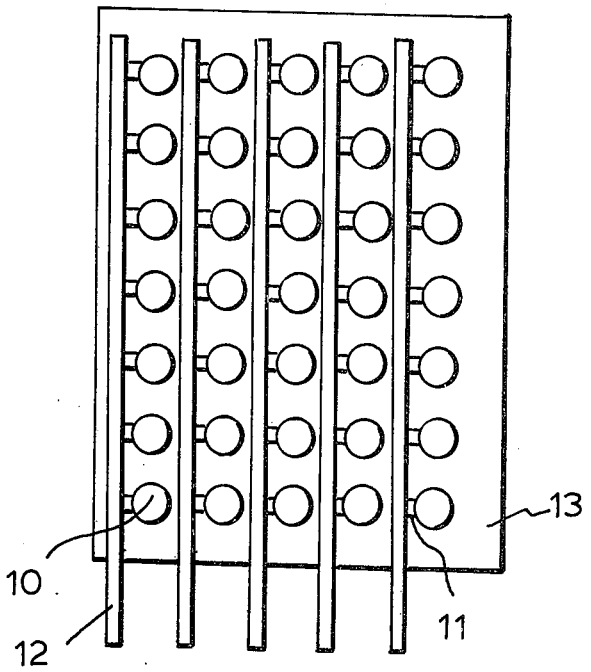
FIG.13
FIG.19
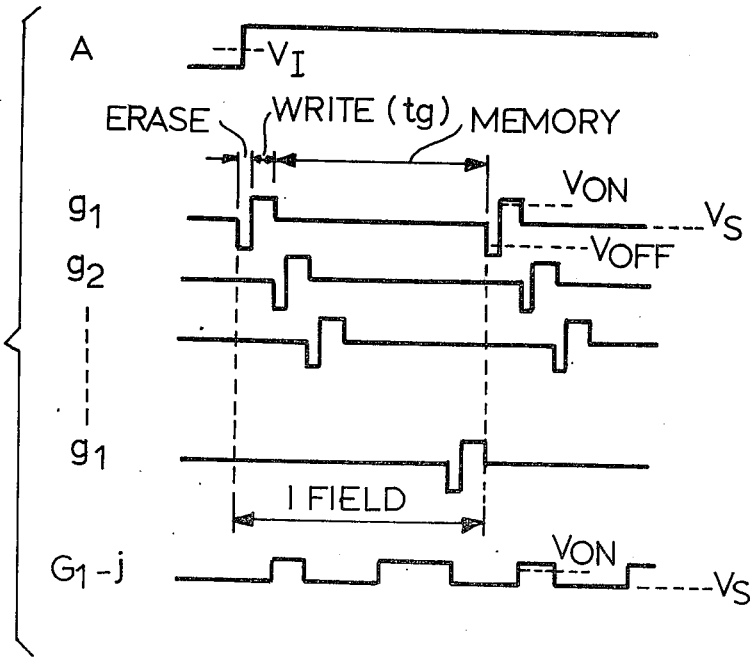

DISPLAY DEVICE USING HOT CATHODE GAS DISCHARGE

The present invention relates to a gas-discharge display device, and particularly to a display device comprising hot cathodes for providing thermal electrons, grids for turning the discharge current on or off and anodes for accelerating the thermal electrons to ionize gas atoms or molecules.

Gas-discharge display devices are well-known devices, and can be classified into two types: d.c. gas-discharge devices and a.c. gas-discharge devices, as taught e.g. by A. Sobel, "Gas-Discharge Displays: The State of the Art" I.E.E.E. Trans. Electron Devices, Vol. ED-24, No. 7, July, 1977, pp. 835–847.

In d.c. gas-discharge devices, the electrodes are immersed in the gas and are supplied with unidirectional pulses. The firing voltage is a function of the gas composition, its pressure and the geometry of the device, and is usually 170 V or more for a typical cathode-glow display. Furthermore, the discharge does not start immediately when the firing voltage is supplied. There must be electrons or ions present in the gap between the electrodes to produce the ionizing events. This requirement leads to a statistical time lag for the breakdown. In addition, there is a formative time lag during which the breakdown process proceeds to a self-sustaining state. These delays can be reduced by increasing applied voltage. In all of the d.c. gas-discharge display devices using cold cathodes, secondary electrons are released from the cathodes by positive-ion or UV-photon bombardment. The secondary electrons are accelerated across the gap between the cold cathode and the positive-ion sheath by a potential of typically about 150 V, and then ionize gas atoms or molecules. Therefore, a firing voltage of 170 V or more is needed to turn the discharge device on. This ionization produces the cathode-glow in a region in the immediate vicinity of the cathode.

In a.c. gas-discharge devices the electrodes are insulated from the gas by thin dielectric films. Charge is stored in the capacitances formed by those dielectric films, and the resulting voltage aids in the re-ignition of the discharge on each half cycle of the applied voltage. The discharge current and the resulting glow light occur in short pulses. Therefore, the display must be operated by a high-frequency signal in order to obtain luminance of the order of 30 fL. Since the stored charge gives the display memory, the sustaining voltage may be below that required to start the discharge. However, the initial firing voltage is required to be high. In the initial firing, the initial time lag is important in a.c. gas-discharge devices, too. The required electrons or ions can be introduced artificially from a nearly discharge. This priming can reduce both the firing voltage and the time lag.

The present invention has successfully solved the drawbacks in both types of gas-discharge devices by using hot cathodes and grids.

It is an object of this invention to provide a novel gas-discharge display device composed of hot cathodes, grids and anodes.

It is a further object of this invention to provide a novel d.c. gas-discharge display device, the firing voltage of which is very low.

It is another object of this invention to provide a matrix-addressed gas-discharge display device wherein the driving voltages are very low.

It is still another object of this invention to provide a matrix-addressed gas-discharge display device wherein the discharge current is turned on or off by the grid voltages.

It is yet another object of this invention to provide a matrix-addressed gas-discharge display device with a display memory.

These and other objects and features of this invention are achieved in accordance with this invention by providing a gas-discharge display device comprising hot cathodes, e.g. in the form of filaments, mesh-shaped grid electrodes, insulating plates with holes as discharge spaces and anode electrodes that are contained in a glass envelope filled with a gas. The pressure of the gas is preferably between 0.1 and 10 mm Hg. The hot cathodes or filaments are operated at low power to supply thermal electrons which are then accelerated by a moderate voltage in order to ionize gas atoms or molecules and produce visible light. If the grid is biased negatively, the discharge current does not flow through the holes to the anode, even if a positive voltage greater than the ionization voltage of the gas is applied to the anode. If the grid is biased slightly positively, electron avalanches occur in the gas leading to excitation and ionization of gas atoms or molecules and subsequent emission of radiation as the excited state decays to a ground state by photon emission. Once the discharge starts, the discharge current cannot be cut-off by the grid bias unless bias voltage thereof is to a voltage lower than a cut-off voltage.

A better understanding of this as well as other objects and further features thereof will become more apparent from the following detailed description taken in connection with the accompanying drawings in which.

Figure 3:
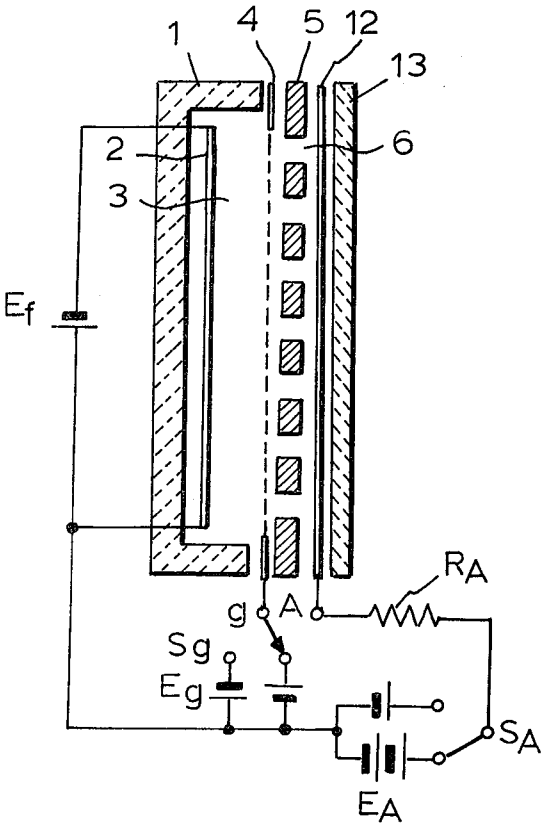
FIG. 3 is a partially schematic, cross-sectional view of the structure of the panel shown in FIG. 2, and an arrangement for supplying the electrodes of that panel with bias voltages.

FIGS. 4*a*–4*c* are diagrams showing the states of the discharge currents vs grid bias voltages for the panel shown in FIG. 3.

Figure 2:
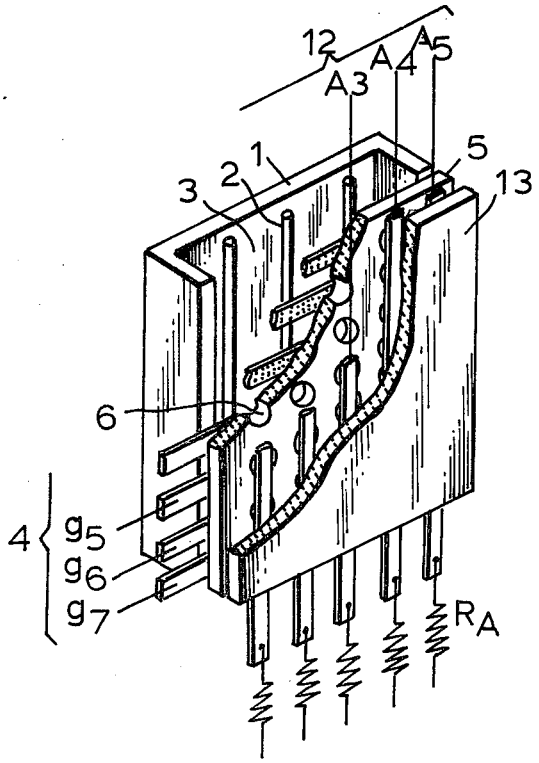
FIG. 2 is a perspective view, partially broken away, of a typical gas-discharge display panel with most essential structures for matrix display according to this invention.

FIG. 5 is a graph showing discharge characteristics vs applied anode voltages and grid voltages according to the classification shown in FIG. 4 for the panel shown in FIG. 2.

Figure 6:
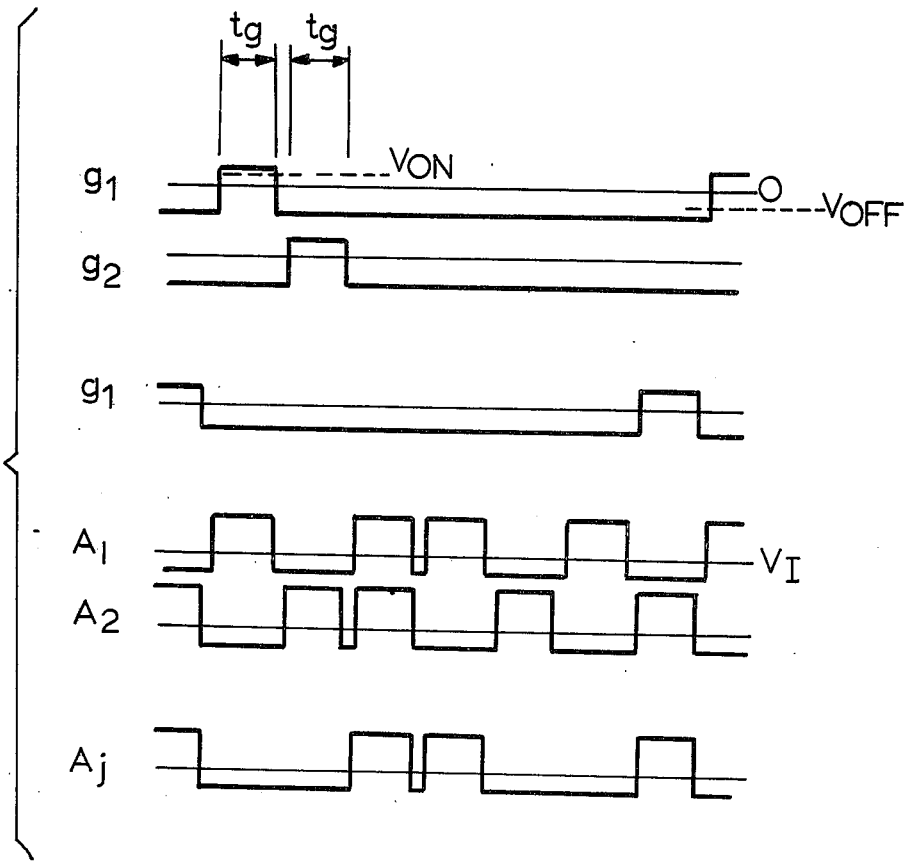

FIG. 6 shows addressing pulses applied to grid electrodes and signal pulses applied to anode electrodes for driving the panel shown in FIG. 2 according to one voltage supplying means of this invention.

Figure 7:
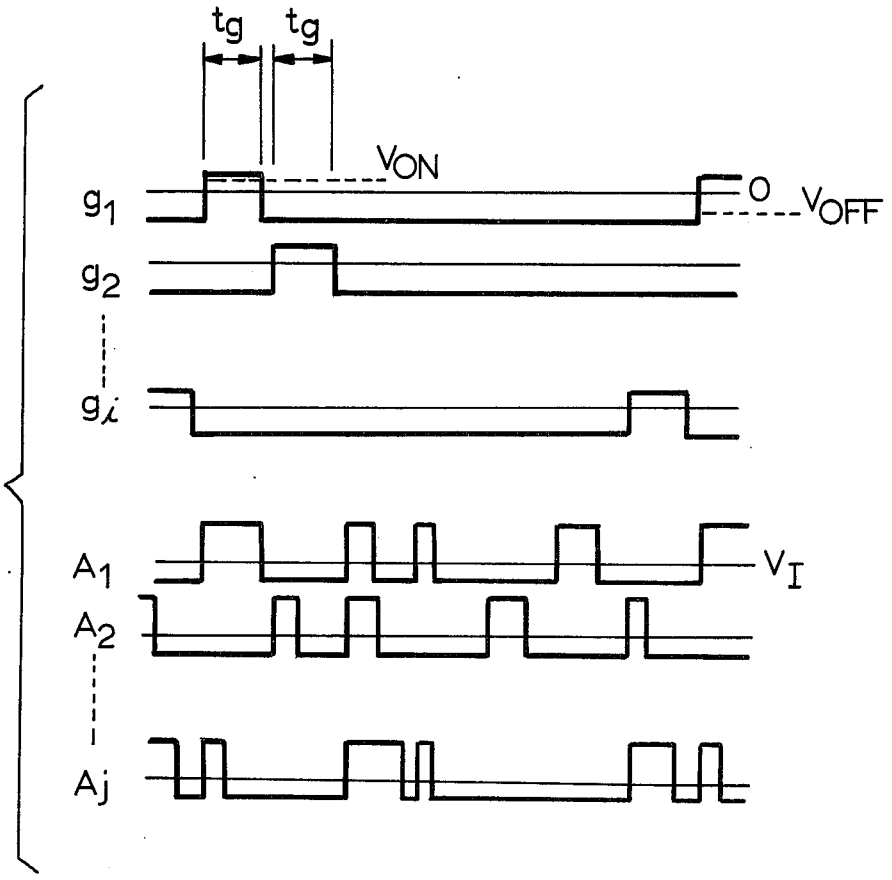

FIG. 7 shows the pulse forms of one means of luminance modulation based on varying pulse durations in the driving method shown in FIG. 6.

Figure 8:
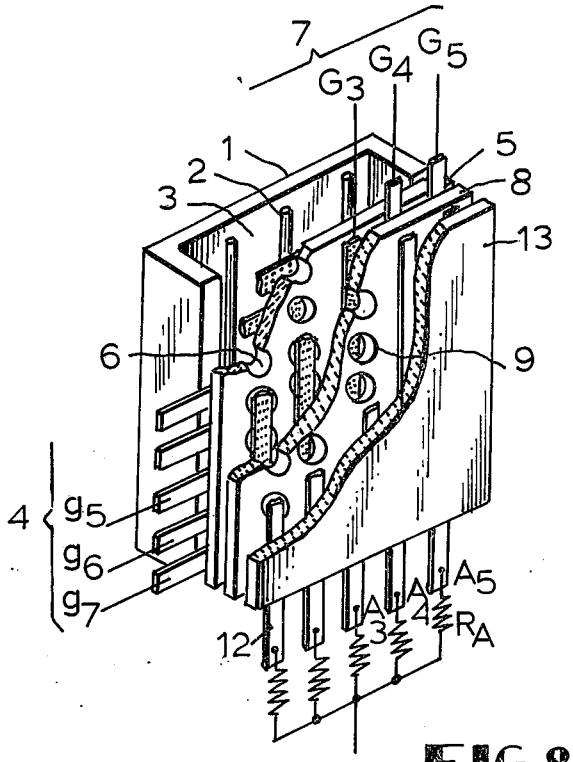

FIG. 8 is a perspective view, partially broken away, of another d.c. gas-discharge matrix display panel of this invention.

Figure 9:
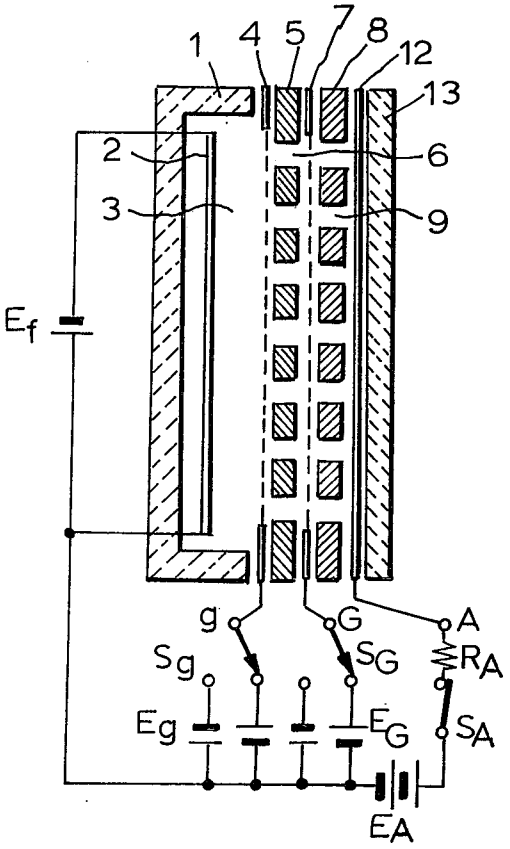

FIG. 9 is a partially schematic, cross-sectional view of the structure of the panel shown in FIG. 8, and an arrangement for supplying bias voltages.

Figure 10:
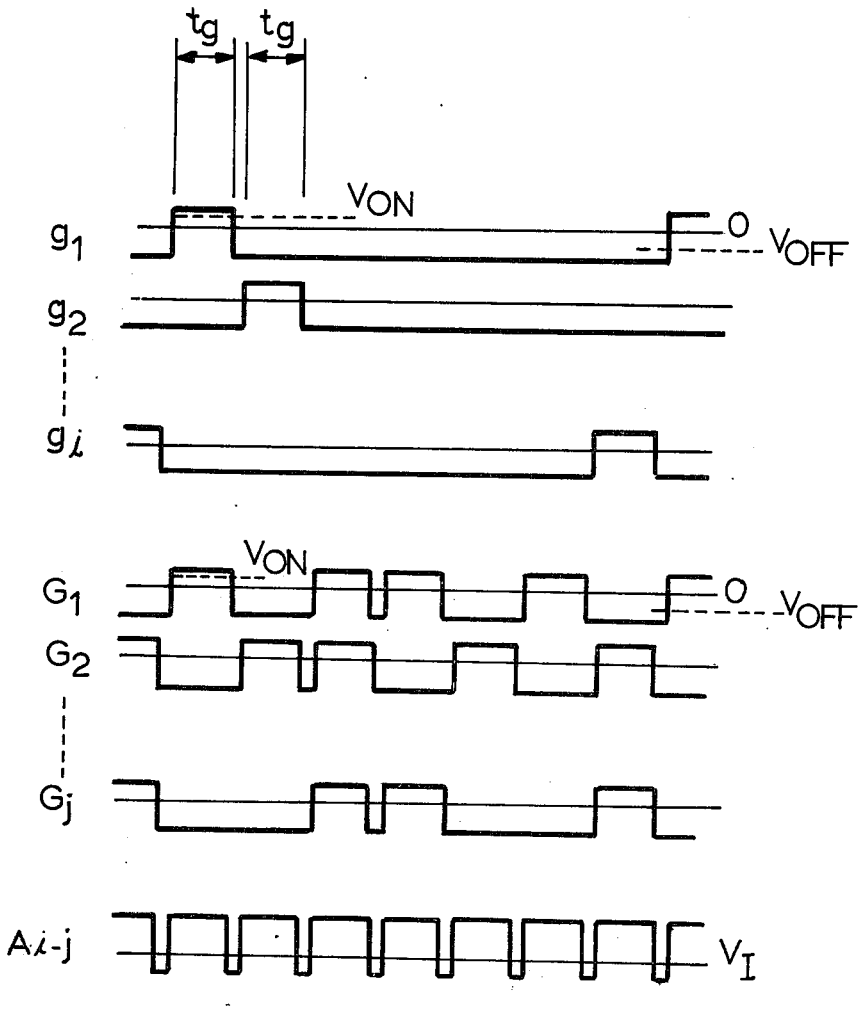

FIG. 10 shows addressing and signal pulses for driving the panel shown in FIG. 8 according to another voltage supplying means of this invention.

Figure 11:
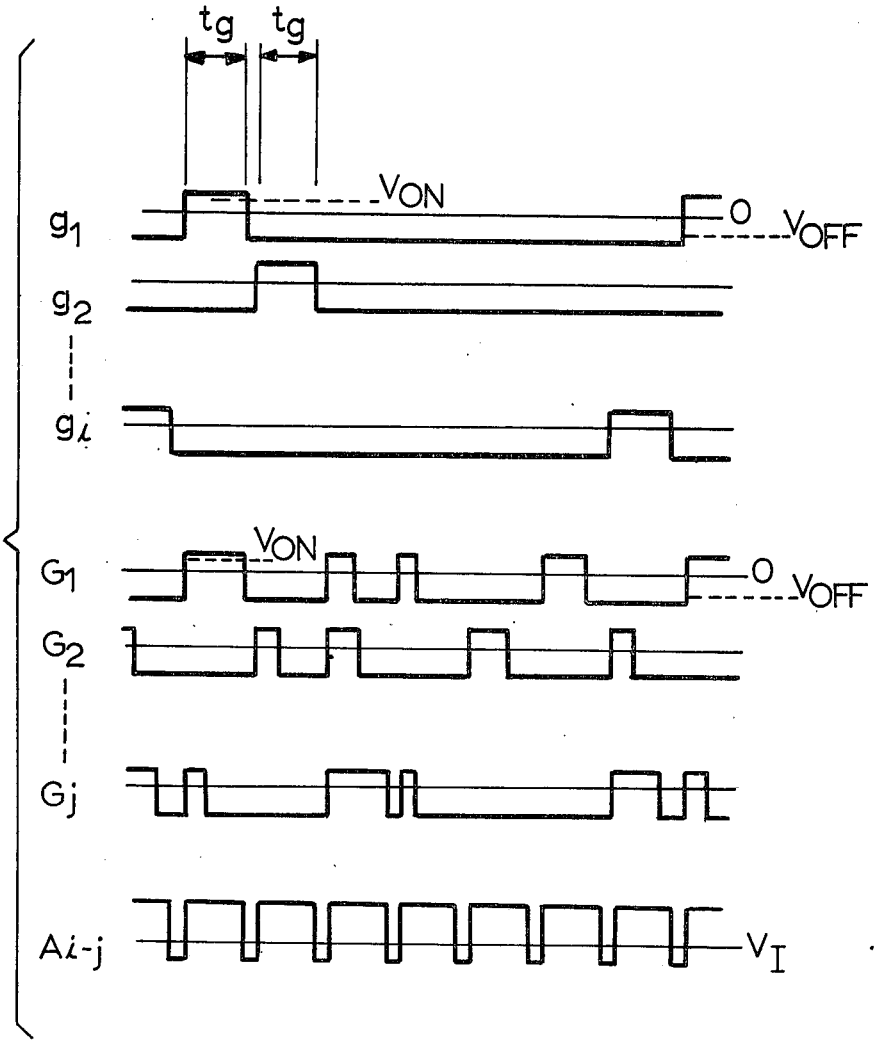

FIG. 11 shows the pulse forms for another means of luminance modulation based on varying pulse durations in the driving method shown in FIG. 10.

Figure 12:
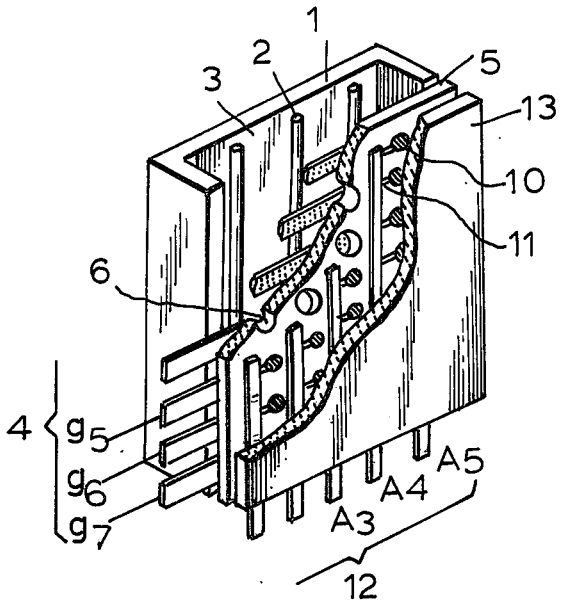

FIG. 12 is a perspective view, partially broken away, of one d.c. gas-discharge matrix display panel with display memory according to this invention.

FIG. 13 is a schematic front view showing an arrangement of a group of anode electrodes on the inner surface of the cover plate of the panel shown in FIG. 12.

Figure 14:
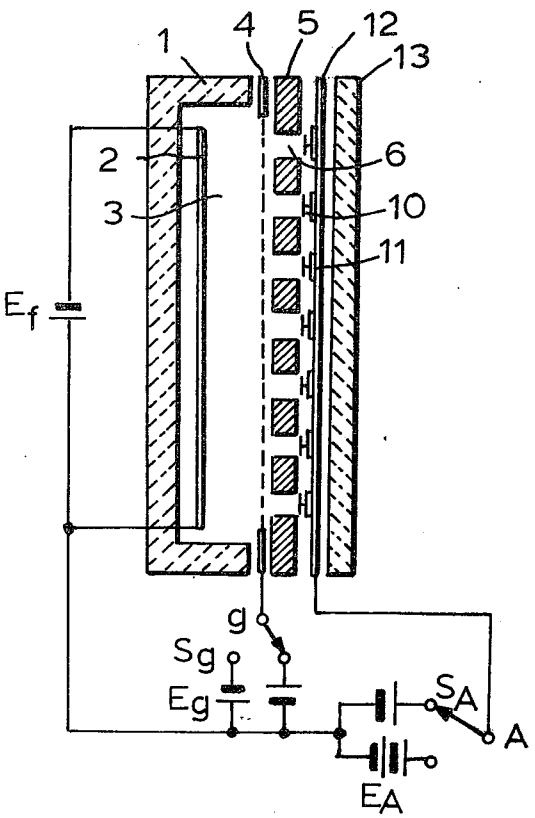

FIG. 14 is a partially schematic, cross-sectional view of the structure of the panel shown in FIG. 12, and an arrangement for supplying bias voltages.

Figure 15:
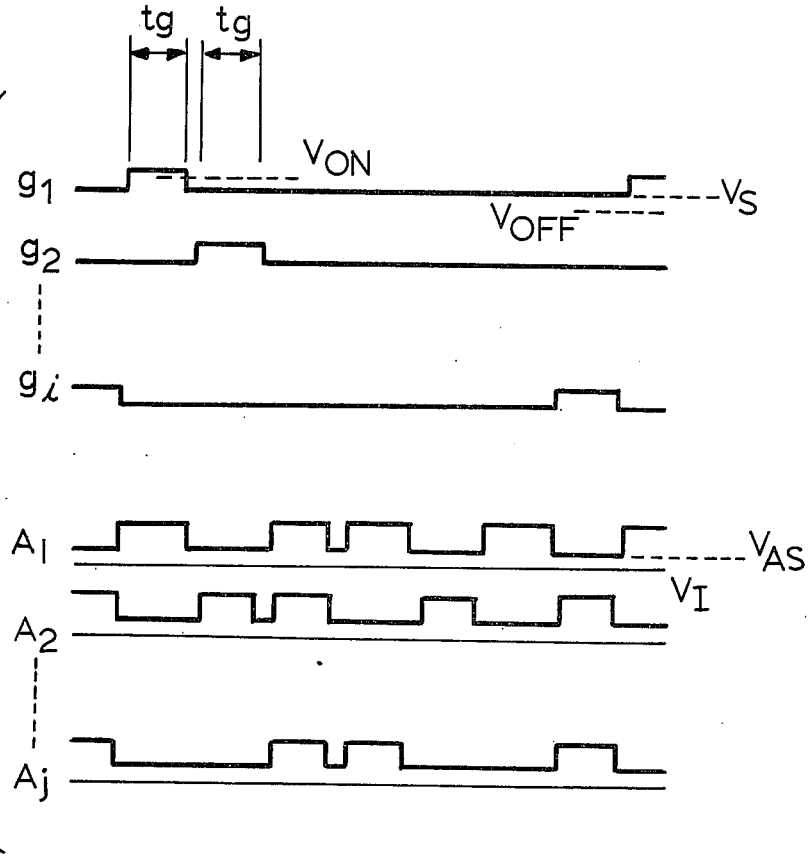

FIG. 15 shows addressing and signal pulses for driving the panel with display memory shown in FIG. 12 according to another voltage supplying means of this invention.

Figure 16:
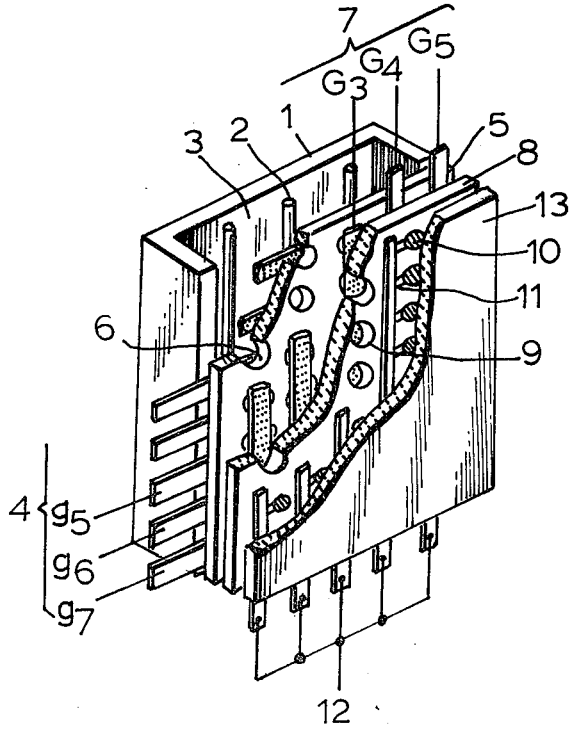

FIG. 16 is a perspective view, partially broken away, of another d.c. gas-discharge matrix display panel with display memory according to this invention.

Figure 17:
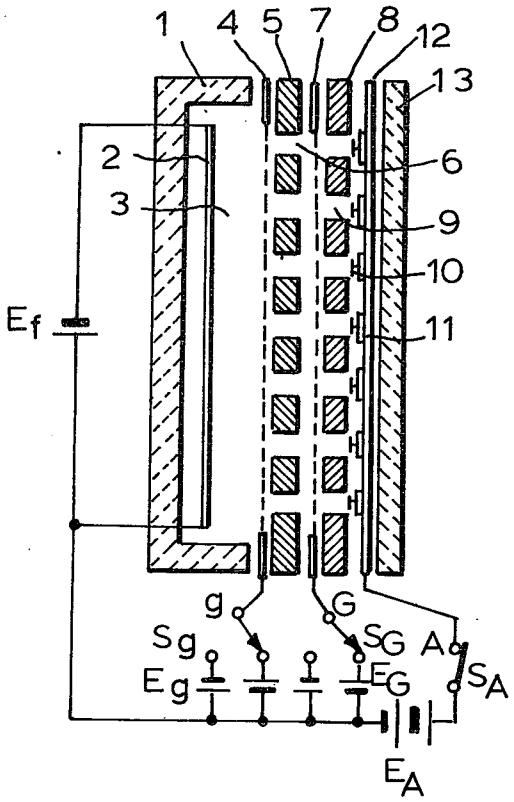

FIG. 17 is a partially schematic, cross-sectional view of the structure of the panel with display memory shown in FIG. 16, and an arrangement for supplying bias voltages.

Figure 18:
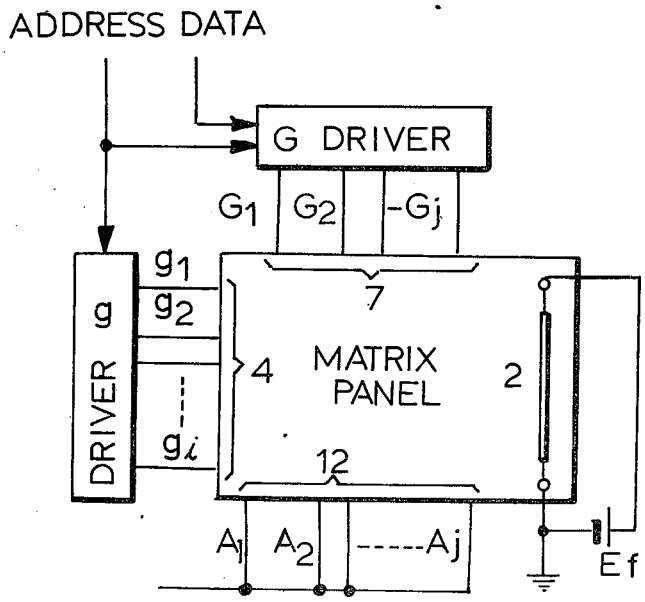

FIG. 18 is a block diagram of means for driving the matrix panel with display memory shown in FIG. 16.

FIG. 19 shows addressing and signal pulses for driving the panel with display memory shown in FIG. 16 one line at a time according to another voltage supplying means of this invention.

Figure 20:
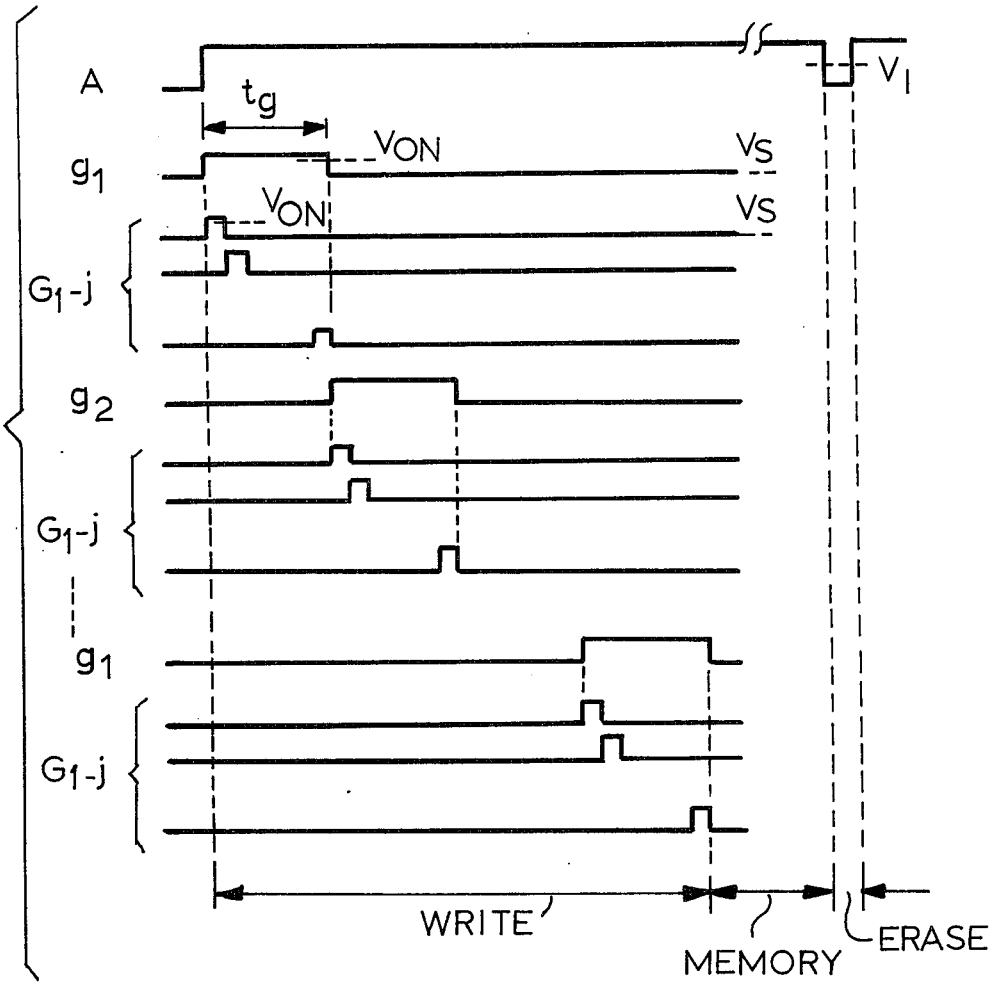

FIG. 20 shows addressing and signal pulses for driving the panel with display memory shown in FIG. 16 dot by dot according to still another voltage supplying means of this invention.

FIG. 21 is a table of dimensions of the panel and its information is self-explanatory.

Figure 1:
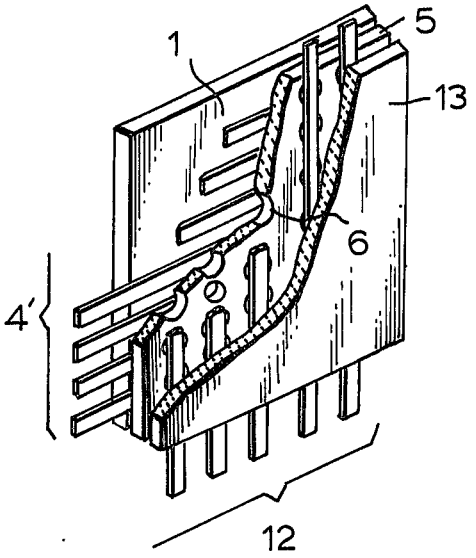
FIG.1 (PRIOR ART)
FIG. 1 is a perspective view, partially broken away, of a well-known d.c. gas-discharge display panel using cold cathodes, for comparison with this invention.

FIG. 1 shows a typical conventional d.c. gas-discharge matrix display panel using cold cathodes, wherein vertical strip-shaped anode electrodes 12 and horizontal strip-shaped cathode electrodes 4' are opposed to each other, and are spaced from each other by means of an insulating plate 5 with regularly aligned discharge holes 6 as discharge-glow spaces. These structures are sandwiched between plates 1 and 13, and means are provided to enclose a gas surrounding the plates and electrodes. These plates 1 and 13 are sealed to these structions to enclose a gas surrounding the plate 5 and electrodes 12 and 4'.

Though the present invention has a slight similarity to the panel structure shown in FIG. 1, it is quite different from the cold cathodes type device with respect to various features as will be apparent from the following description.

FIG. 2 shows a typical d.c. gas-discharge matrix display panel according to this invention. Referring to this figure, a plurality of vertical strip-shaped anode electrodes 12 ($A_1, A_2, \ldots, A_j$) are placed on the inner surface of second airtight plate 13 such as a glass plate, and are sandwiched between said second plate and one surface of an insulating plate 5 such as a glass or ceramic plate which has regularly aligned discharge holes 6 as discharge-glow spaces. Said anode electrodes may be transparent conductive layers such as $SnO_2$ or $In_2O_3$, semi-transparent conductive plates such as metallic mesh-screen or non-transparent metallic plates. A plurality of horizontal strip-shaped grid electrodes 4($g_1, g_2, \ldots, g_i$) having many holes for passage of thermal electrons for example, metallic mesh-screen, are placed on the other surface of said insulating plate. Said anode and grid electrodes are opposed to each other, and are spaced by means of said insulating plate, and are crossed at said discharge holes of said plate in a manner such that the direction of said anode electrodes is perpendicular to that of said grid electrodes. Cathodes or filament wires are inserted in a space 3 between said grid electrodes and a first airtight plate 1. Said cathodes 2 are actually an array of oxide-coated tungsten filament wires that generate thermal electrons as do directly heated cathodes. At least either said first or second plate should be transparent for observing the display. Said first and second plates form an airtight envelope, which is filled with gas such as He, Ne, Ar, Kr, Xe, $H_2$ and/or metallic vapor such as Hg.

FIG. 3 is a cross-sectional view of the matrix panel shown in FIG. 2, and an arrangement for applying voltages to each electrode. Referring to this figure, a filament voltage $E_f$ is being applied to cathodes or filament wires 2, so the space 3 near the hot cathodes is filled with thermal electrons. A grid voltage $E_g$ is applied to each of grid electrodes 4 by respective switches $S_g$. An anode voltage $E_A$ is applied to each of the anode electrodes 12 through respective resistors of a series of resistors $R_A$ by respective switches.

FIGS. 4a–4c shows the behavior of discharge current $I_A$ against various grid voltages $V_g$, when the anode voltage $V_A$ is greater than the ionization voltage $V_I$ of the enclosing gas.

FIG. 5 shows an example of the discharge characteristics in which the discharge glow in a discharge hole is turned on or off by anode voltages $V_A$ and grid voltages $V_g$, when the matrix panel is filled with neon plus 0.5% argon at a pressure of about 1 mm Hg.

In the construction as shown in FIGS. 2 and 3, thermal electrons released from hot cathodes are accelarated by an anode voltage $V_A$ greater than the ionization voltage $v_I$ [e.g. $V_I \simeq 21$ V for a mixture of neon plus 0.5% argon and $V_A \gtrsim 24$ V] to ionize gas atoms or molecules and then produce visible light [e.g., neon red-orange color]. The discharge glow is observed near the anode electrode as the anode voltage becomes about 24 V. As the anode voltage is increased further, the glow spreads toward the hot cathode. If there is no grid electrode, the glow is not localized near the anode electrode. Owing to the grid electrode being biased positively, the discharge glow is confined in the discharge hole between the grid and anode electrodes.

According to FIGS. 4 and 5, the discharge glow is stable and occurs without delay if the grid voltage $V_g$ is above $V_{ON}$ when the anode voltage $V_A$ is higher than the ionization voltage $V_I$ of the enclosing gas. If the grid voltage is switched to a negative bias lower than $V_{OFF}$ after the discharge glow has started, the glow disappears soon, even when the anode voltage is higher than the ionization voltage. The grid electrodes held at a negative potential lower than $V_{OFF}$ can prevent the penetration of thermal electrons into the discharge holes of the insulating plate in spite of the anode voltage being higher than the ionization voltage. In the example shown in FIG. 5, where the panel is filled with a mixture of neon plus 0.5% argon at about 1 mm Hg, the ionization voltage is about 21 V and the anode voltage is required to be higher than 24 V. For example, the discharge glow is observed if $V_g \gtrsim 0.8$ V when $V_A \equiv 40$ V, and $V_g \gtrsim 3$ V is needed when $V_A = 30$ V. The discharge current can be cut off if $V_g \sim 0$ V when $V_A = 30$ V, and $V_g \lesssim -3$ V is needed when $V_A = 40$ V. In the case of $v_{ON} > v_1 > V_{S1}$, the discharge glow will start, but has a long rise-time and is metastable. Once the discharge starts stably, the discharge current cannot be cut off by a grid voltage in the region III ($v_{S1} > v_2 > V_{S2}$), and the glow remains in the memory state. When the grid voltage is decreased to a value between $v_{S2}$ and $V_{OFF}$, the glow has a long decay-time.

In the d.c. gas-discharge display panel of this invention, the discharge glow can be turned on or off not only by means of the anode voltage but also by means of the grid voltage. Furthermore the discharge glow is sustained by a grid bias in a memory region between $v_{ON}$ and $v_{OFF}$ when the anode voltage is higher than the ionization voltage. If grid electrodes, anode electrodes and discharge holes are arranged in a seven-segment, eight-segment or thirteen segment format, the gas-discharge display panel of this invention can display numbers or letters with a drive voltage lower than 40~50 V. In a matrix display panel as shown in FIG. 2, alphanumeric characters or graphics can be displayed by a line-at-a-time addressing method, i.e., each of the grid electrodes is scanned sequentially.

FIG. 6 shows examples of an addressing pulse g applied sequentially to the respective grid electrodes and examples of signal pulses applied to the anode electrodes. When an addressing pulse higher than $v_{ON}$ and with a duration $t_g$ is applied to one selected grid electrode, thermal electrons can penetrate into the corresponding discharge holes of the insulating plate. Unselected remaining grid electrodes are biased by a negative voltage lower than $v_{OFF}$. Synchronously with the addressing pulse, signal pulses A higher than $v_I$ and with a duration $t_g$ are simultaneously applied to some of the anode electrodes corresponding to information signals for the selected grid electrode. Remaining anode electrodes are held at zero potential or lower than $v_I$. When the signal pulse is sufficiently higher than $v_I$, the thermal electrons are accelerated by the anode voltage, resulting in the discharge glow.

Since the average intensity of the glow light is proportional to the average value of the duration of the discharge currents, the luminance of a display cell which is constantly biased is proportional to the duration during the time the cell is being selected, and therefore luminance can be modulated by varying the duration of signal pulses up to $t_g$ in the driving method shown in FIG. 6. FIG. 7 shows an example of addressing pulses and signal pulses for such a method.

A part of data obtained for a panel which embodies the present invention as shown in FIG. 2 are shown in Table 1 of FIG. 21. This panel has ten grid electrodes of strip-shaped metallic mesh, seven anode electrodes of strip-shaped metal plate and one insulating plate of black-colored ceramic having circular holes which form a matrix of 10×7 display elements. The holes have a diameter of 1.5 mm and a depth of 0.5 mm and are regularly aligned at a pitch of 2.6 mm. Addressing is line-sequential as shown in FIG. 6. Frame frequency is 60 Hz. A bright alpha-numeric display having good contrast is achieved using 5×7 dots.

FIG. 8 shows another example of a d.c. gas-charge matrix display panel according to this invention. Referring to this figure, a plurality of vertical strip-shaped anode electrodes 12 are placed on the inner surface of a second airtight plate 13, and are sandwiched between said second airtight plate and one surface of a second insulating plate 8 such as a glass or ceramic plate which has regularly aligned discharge holes 9 as discharge-glow spaces. A plurality of vertical strip-shaped second grid electrodes 7 ($G_1$, $G_2$, . . . , $G_j$) having many holes for passage of thermal electrons are placed on the opposite surface of said second insulating plate and are sandwiched between said second insulating plate and one surface of a first insulating plate 5 which has regularly aligned holes 6. Said anode and second grid electrodes are parallel to each other, and spaced from each other by means of said second insulating plate. Said holes in said first insulating plate are in a one-to-one correspondence with said discharge holes of said second insulating plate. A plurality of horizontal strip-shaped first grid electrodes 4 having many holes for passage of thermal electrons are placed on the opposite surface of said first insulating plate. Said first and second grid electrodes are opposed to each other, and are spaced from each other by means of said first insulating plate and crossed at said holes of first insulating plate in a manner such that the direction of said first grid electrodes is perpendicular to that of said second grid electrodes. Cathodes or filament wires 2 are inserted in a space 3 between said first grid electrodes and a first airtight plate 1. Said first and second plates form an airtight envelope which is filled with inert gas, metallic vapor or a mixture thereof.

Referring to FIG. 9, a filament voltage $E_f$ is applied to cathodes or filament wires 2, so the space near hot cathodes 3 is filled with thermal electrons. A grid voltage $E_g$ is applied to each of first grid electrodes 4 by respective switches $S_g$, and another grid voltage $E_G$ is applied to each of second grid electrodes 7 by respective switches $S_G$. Each of voltages $E_g$ and $E_G$ is higher than $v_{ON}$ or lower than $v_{OFF}$. An anode voltage $E_A$ higher than the ionization voltage $v_I$ is constantly applied to each of anode electrodes 12 through respective series resistors $R_A$ by only one switch $S_A$. Each of the first and second grid electrodes is held at a negative potential lower than $v_{OFF}$ in order to prevent the penetration of thermal electrons into the holes 6 of the first insulating plate 5 and also into the discharge holes 9 of the second insulating plate 8.

FIG. 10 shows examples of addressing pulses g applied sequentially to each of first grid electrodes and examples of signal pulses G applied to second grid electrodes. When an addressing pulse higher than $v_{ON}$ and with a duration $t_g$ is applied to selected ones of the first grid electrodes, thermal electrons can penetrate into the corresponding holes of the first insulating plate. Synchronously with the addressing pulse, signal pulses either higher than $v_{ON}$ or lower than $v_{OFF}$ and with a duration $t_g$ are simultaneously applied to some of the second grid electrodes corresponding to information signals for the selected first grid electrodes. When the signal pulse is higher than $v_{ON}$, the thermal electrons can penetrate into the corresponding discharge hole of the second insulating plate, and are accelerated by an anode voltage higher than $v_I$, resulting in the discharge glow. If the signal pulse is lower than $v_{OFF}$, the thermal electrons can not penetrate into the discharge hole. FIG. 11 shows an example of addressing pulses and signal pulses for a luminance-modulating method by varying the duration of the signal pulses in FIG. 10.

FIG. 12 shows an example of d.c. gas-discharge matrix display panel with display memory according to this invention. Referring to this figure, a plurality of regularly aligned anode electrodes 10 are placed on the inner surface of a second airtight plate 13, and are connected to vertical strip-shaped anode leads 12 via respective series resistors 11, and are sandwiched between said second plate and one surface of an insulating plate 5 which has regularly aligned discharge holes 6 as discharge-glow spaces which correspond to said anode electrodes. A plurality of horizontal strip-shaped grid electrodes 4 having many holes for passage of thermal electrons are placed on the opposite surface of said insulating plate. Said anode leads and grid electrodes are opposed to each other, and are spaced from each other by means of said insulating plate, and are crossed at said discharge holes of said plate in a manner such that the direction of said anode leads is perpendicular to that of said grid electrodes. Cathodes or filament wires 2 are inserted in a space 3 between said grid electrodes and a first airtight plate 1. Said first and second plates form an airtight envelope, which is filled with inert gas, metallic vapor or a mixture thereof.

FIG. 13 shows an arrangement of anode electrodes 10, series resistors 12 and anode leads 11 that are prepared by a method such as screen-printing on the inner surface of the second airtight plate 13.

Referring to FIG. 14, a filament voltage $E_f$ is applied to cathodes or filament wires 2, so that the space near hot cathodes 3 is filled with thermal electrons. A grid voltage $E_g$ is applied to each of grid electrodes 4 by respective switches $S_g$. An anode voltage $E_A$ is applied to each of anode leads 12 through respective switches $S_A$.

A d.c. gas-discharge matrix display panel incorporating a resistor in series with each cell may be addressed either dot sequentially or row (or column) sequentially. In an example of pulses used for such an addressing method as shown in FIG. 15, each of the grid electrodes is addressed line sequentially. An addressing pulse g higher than $v_{ON}$ and with a duration $t_g$ is applied to each of the grid electrodes sequentially, and synchronously with the addressing pulse, signal pulses A higher than the ionization voltage $v_I$ are applied to some of the anode leads corresponding to information signals for the selected grid electrode. As seen from FIGS. 4 and 5 a discharge glow is turned on (i.e., some discharge holes are selected) if the grid voltage $V_g$ is increased above $v_{ON}$, when the anode voltage $V_A$ is a firing voltage higher than the ionization voltage of the enclosing gas $v_I$. Once the discharge-glow starts, in order to sustain the glow, the grid voltage must be held in the memory region between $v_{ON}$ and $v_{OFF}$, and furthermore, the anode voltage must be sufficiently higher than the ionization voltage when the grid voltage is in the memory region. Therefore, the grid electrodes should be biased by a d.c. voltage bias in the memory region, and the anode leads should be biased by a d.c. sustaining voltage bias $v_{AS}$ higher than the ionization voltage. However, the sustaining anode voltage must be insufficient to start the discharge glow in unselected discharge holes biased by a grid voltage in the memory region. Once all of the grid electrodes are scanned, the display is sustained by the memory bias voltage applied to the grid electrodes and by the sustaining voltage bias applied to anode leads even without refreshing. In order to erase the display, the grid voltage applied to all of the grid electrodes should be decreased to less than $v_{OFF}$, or else the anode voltage applied to all of the anode leads should be decreased to less than $v_I$.

FIG. 16 shows another example of a d.c. gas-discharge matrix display panel with display memory according to this invention. Referring to this figure, a plurality of regularly aligned anode electrodes 10 are placed on the inner surface of second airtight plate 13, and are connected to vertical strip-shaped anode leads 12 via respective series resistors 11, as shown in FIG. 13, and are sandwiched between said second airtight plate and one surface of a second insulating plate 8 which has regularly aligned discharge holes 9 as discharge-glow spaces which correspond to said anode electrodes. A plurality of vertical strip-shaped second grid electrodes 7 having many holes for passage of thermal electrons are placed on the opposite surface of said second insulating plate, and are sandwiched between said second insulating plate and one surface of a first insulating plate 5 which has regularly aligned holes 6. Said anode and second grid electrodes are parallel to each other, and are spaced from each other by means of said second insulating plate. Said holes of said first insulating plate are in a one-to-one correspondence with said discharge holes of said second insulating plate. A plurality of horizontal strip-shaped first grid electrodes 4 having many holes for passage of thermal electrons are placed on the opposite surface of said first insulating plate. Said first and second grid electrodes are opposed to each other, and are spaced from each other by means of said first insulating plate and crossed at said holes of first insulating plate in a manner such that the direction of said first grid electrodes is perpendicular to that of said second grid electrodes. Cathodes or filament wires 2 are inserted in a space 3 between said first grid electrodes and a first airtight plate 1. Said first and second plates form an airtight envelope, which is filled with inert gas, metallic vapor or a mixture thereof.

Referring to FIG. 17, a filament voltage $E_f$ is applied to cathodes or filament wires 2, so that the space near hot cathodes 3 is filled with thermal electrons. A grid voltage $E_g$ is applied to each of first grid electrodes 4 by respective switches $S_g$, and another grid voltage $E_G$ is applied to each of second grid electrodes 7 by respective switches $S_G$. An anode voltage $E_A$ is applied to anode leads 12 by only one switch $S_A$.

The first grid electrodes are addressed line sequentially, and during the line address period the second grid electrodes are simultaneously addressed corresponding to information signals. The anode voltage is held above the ionization voltage of gas filling $v_I$.

FIGS. 18~20 show means to drive the matrix display panel with display memory shown in FIG. 16. FIG. 18 is a block diagram of drive circuits. Addressing pulses are shown for addressing line-sequentially in FIG. 19 and dot-sequentially in FIG. 20. Both first and second grid electrodes are biased by a d.c. voltage bias $v_S$ in the memory region between $v_{ON}$ and $v_{OFF}$ in order to sustain the glow. An addressing pulse g higher than $v_{ON}$ and with a duration $t_g$ is applied to each of the first grid electrodes sequentially, and synchronously with the addressing pulse, signal pulses G higher than $v_{ON}$ are applied to some of the second grid electrodes corresponding to information signals for the selected first grid electrode. Once the discharge-glow starts, it stays on until specifically switched off. The display memory is erased by a erasing pulse applied to first grid electrodes lower than $v_{OFF}$ in FIG. 19, and by an anode voltage bias lower than $v_I$ in FIG. 20. In FIG. 20, writing in of information signals is finished during the first field, and the display is held during remaining intervals. It is useful for simplification according to drive circuits that a display device of this invention has a memory function.

As described herein before, the present invention provides a novel d.c. gas-discharge display device which is without any time-lag at the start of discharge and is driven by low voltages.

What we claim is:

1. A d.c. gas-discharge display device comprising:

a gas-discharge display panel including hot cathodes inserted in a thermal electron generating space, an insulating plate having holes therein serving as discharge-glow spaces and having on one surface thereof grid electrodes with holes for passage of thermal electrons and on another surface thereof anode electrodes, and gas, metallic vapor or a mixture thereof, which fills the space in said display panel;

voltage generating means coupled to said cathodes, said voltage generating means supplying said cathodes with a potential to provide thermal electrons;

first pulse generating means coupled to said grid electrodes, said first pulse generating means supplying said grid electrodes with a voltage pulse, said pulse having a voltage level higher than $V_{ON}$ and being biased by a d.c. voltage lower than $v_{OFF}$;

second pulse generating means coupled to said anode electrodes, said pulse generating means supplying said anode electrodes with a positive voltage pulse, said positive voltage pulse having a voltage level higher than the ionization voltage of said gas, metallic vapor or mixture thereof and being biased by a d.c. voltage between ground level and said ionization voltage;

whereby the discharge glow in each discharge hole is turned on during the period the pulse applied to the grid electrode and the pulse applied to the anode electrode coincides.

2. A d.c. gas-discharge display device as claimed in claim 1, wherein said grid electrodes, said anode electrodes and said discharge holes of said insulating plate are arranged in a manner that the discharge glow in said discharge holes displays numbers, characters, graphs or images.

3. A d.c. gas-discharge display device comprising:

a gas-discharge display panel including hot cathodes inserted in a thermal electron generating space, an insulating plate having regularly aligned discharge holes therein serving as discharge-glow spaces and having on one surface thereof a plurality of strip-shaped grid electrodes with many holes for passage of thermal electrons and on the opposite surface thereof a plurality of strip-shaped anode electrodes, and gas, metallic vapor or a mixture thereof, which fills the space in said display panel, wherein said strip-shaped grid electrodes and said strip-shaped anode electrodes are opposed to each other in a manner such that the direction of said grid electrodes is perpendicular to that of said anode electrodes so that said grid electrodes and said anode electrodes with said discharge holes therebetween form a plurality of display elements at the intersections thereof;

voltage generating means coupled to said cathodes, said voltage generating means supplying said cathodes with a potential to provide thermal electrons;

first pulse generating means coupled to each of said grid electrodes, said first pulse generating means supplying said cathodes with a potential to provide thermal electrons;

first pulse generating means coupled to each of said grid electrodes, said first pulse generating means supplying said grid electrodes with an addressing voltage pulse sequentially, said addressing voltage pulse having a voltage level higher than $v_{ON}$ and a predetermined duration and being biased by a d.c. voltage bias lower than $v_{OFF}$;

second pulse generating means coupled to each of said anode electrodes, said second pulse generating means supplying each of said anode electrodes with a positive voltage signal pulse, said positive voltage signal pulse having a voltage level higher than the ionization voltage of said gas, metallic vapor or the mixture thereof, and a duration up to said predetermined duration which is varied with a change in an information signal, said positive voltage signal pulse being biased by a d.c. voltage bias between ground level and said ionization voltage;

whereby each discharge hole glows during the period the addressing voltage pulse applied to the grid electrode and the signal pulse applied to the anode electrode coincides.

4. A d.c. gas-discharge display device comprising:

a gas-discharge display panel including hot cathodes inserted in a thermal electron generating space, a first insulating plate having regularly aligned holes therein and having on one surface thereof a plurality of strip-shaped first grid electrodes and on the opposite surface thereof a plurality of strip-shaped second grid electrodes, said strip-shaped first and second grid electrodes having many holes therein for passage of thermal electrons, a second insulating plate having regularly aligned discharge holes therein serving as discharge-glow spaces and having on one surface thereof a plurality of strip-shaped second grid electrodes and on the opposite surface thereof a plurality of strip-shaped anode electrodes, and gas, metallic vapor or a mixture thereof, which fills the space in said display panel, wherein said strip-shaped first and second grid electrodes are opposed to each other in a manner such that the direction of said first grid electrodes is perpendicular to that of said second grid electrodes so that said first and second grid electrodes form a plurality of display elements at the intersections thereof, the direction of said second grid electrodes is parallel to that of said anode electrodes, and the discharge glow occurs in said discharge holes therebetween corresponding to said display elements;

first voltage generating means coupled to said cathodes, said first voltage generating means supplying a potential to said cathodes to provide thermal electrons;

first pulse generating means coupled to each of said first grid electrodes, said first pulse generating means supplying said first grid electrodes with an addressing voltage pulse sequentially, said addressing voltage pulse having a voltage level higher than $v_{ON}$ and a predetermined duration and being biased by a d.c. voltage bias lower than $v_{OFF}$;

second pulse generating means coupled to each of said second grid electrodes, said second pulse generating means supplying said second grid electrodes with a signal voltage pulse, said signal voltage pulse having a voltage level higher than $v_{ON}$ and a duration up to said predetermined duration which is varied with a change in an information signal, said signal voltage pulse being biased by a d.c. voltage bias lower than $v_{OFF}$;

second voltage generating means coupled to each of said anode electrodes, said second voltage generating means supplying each of said anode electrodes with a positive d.c. voltage higher than the ionization voltage of said gas, metallic vapor or the mixture thereof;

whereby each discharge hole glows during the period the addressing voltage pulse applied to the first grid electrode and the signal voltage pulse applied to the second grid electrode coincides.

5. A d.c. gas-discharge display device comprising:

a gas-discharge display panel including hot cathodes inserted in a thermal electron generating space, an insulating plate having regularly aligned discharge holes therein as discharge-glow spaces and having on one surface thereof a plurality of strip-shaped grid electrodes with many holes for passage of thermal electrons and on the opposite surface thereof a plurality of anode electrodes corresponding to said discharge holes, and gas, metallic vapor or a mixture thereof, which fills the space in said display panel, wherein each of said anode electrodes is connected to strip-shaped anode leads via a series resistor, and said strip-shaped grid electrodes and anode leads are opposed to each other in a manner such that the direction of said grid electrodes is perpendicular to that of said anode leads;

voltage generating means coupled to said cathodes, said voltage generating means supplying said cathodes with a potential to provide thermal electrons;

first pulse generating means coupled to each of said grid electrodes, said first pulse generating means supplying said grid electrodes with an addressing voltage pulse sequentially, said addressing voltage pulse having a voltage level higher than $v_{ON}$ and a predetermined duration, and being biased by a d.c. voltage bias in a memory region between $v_{ON}$ and $v_{OFF}$;

second pulse generating means coupled to each of said anode leads, said second pulse generating means supplying each of said anode leads with a positive voltage signal pulse, said positive voltage signal pulse having a voltage level higher than the ionization voltage of said gas, metallic vapor or the mixture thereof, and a duration up to said predetermined duration, and being biased by a d.c. sustaining voltage bias between said ionization voltage and said signal voltage level;

whereby the discharge-glow is turned on by the simultaneous excitation of the addressing voltage pulse applied to the grid electrodes and of the signal pulse applied to the anode leads, and is sustained by the voltage bias in a memory region applied to the grid electrodes and by the sustaining voltage applied to the anode leads.

6. A d.c. gas-discharge display device comprising:

a gas-discharge display panel including hot cathodes inserted in a thermal electron generating space, a first insulating plate having regularly aligned holes therein and having on one surface thereof a plurality of strip-shaped first grid electrodes and on the opposite surface thereof a plurality of strip-shaped second grid electrodes, said strip-shaped first and second grid electrodes having many holes for passage of thermal electrons, a second insulating plate having regularly aligned discharge holes therein serving as discharge-glow spaces and having on one surface thereof a plurality of strip-shaped second grid electrodes and on the opposite surface thereof a plurality of anode electrodes corresponding to said discharge holes, and gas, metallic vapor or a mixture thereof, which fills the space in said display panel, wherein said strip-shaped first and second grid electrodes are opposed to each other in a manner such that the direction of said first grid electrodes is perpendicular to that of said second grid electrodes, and each of said anode electrodes is connected to strip-shaped anode leads via a series resistor;

first voltage generating means coupled to said cathodes, said first voltage generating means supplying said cathodes with a potential to provide thermal electrons;

first pulse generating means coupled to each of said first grid electrodes, said first pulse generating means supplying said first grid electrodes with an addressing voltage pulse sequentially, said addressing voltage pulse having a voltage level higher than $v_{ON}$ and a predetermined duration, and being biased by a d.c. voltage bias in a memory region between $v_{ON}$ and $v_{OFF}$;

second pulse generating means coupled to each of said second grid electrodes, said second pulse generating means supplying each of said second grid electrodes with a signal voltage pulse, said signal voltage pulse having a voltage level higher than $v_{ON}$ and a duration up to said predetermined duration, and being biased by a d.c. voltage bias in a memory region between $v_{ON}$ and $v_{OFF}$;

second voltage generating means coupled to said anode leads, said second voltage generating means supplying said anode leads with a positive d.c. voltage higher than the ionization voltage of said gas, metallic vapor or the mixture thereof;

whereby discharge-glow is turned on by the simultaneous excitation of the addressing voltage pulse applied to the first grid electrodes and of the signal voltage pulse applied to the second grid electrodes, and is sustained by the voltage bias in a memory region applied to the first and second grid electrodes and by the voltage applied to the anode leads.

* * * * *